US011632622B2

(12) United States Patent
Rumyantsev

(10) Patent No.: US 11,632,622 B2
(45) Date of Patent: Apr. 18, 2023

(54) FULL ACOUSTIC HORN AND METHOD FOR PRODUCING SAME

(71) Applicant: Konstantin Rumyantsev, Syktyvkar (RU)

(72) Inventor: Konstantin Rumyantsev, Syktyvkar (RU)

( * ) Notice: Subject to any disclaimer, the term of this patent is extended or adjusted under 35 U.S.C. 154(b) by 930 days.

(21) Appl. No.: 16/471,186

(22) PCT Filed: Dec. 14, 2017

(86) PCT No.: PCT/RU2017/050128
§ 371 (c)(1),
(2) Date: Jun. 19, 2019

(87) PCT Pub. No.: WO2018/117915
PCT Pub. Date: Jun. 28, 2018

(65) Prior Publication Data

US 2019/0394562 A1 Dec. 26, 2019

(30) Foreign Application Priority Data

Dec. 21, 2016 (RU) ..... RU2016150614

(51) Int. Cl.
*H04R 1/30* (2006.01)
*H04R 1/28* (2006.01)
*H04R 1/34* (2006.01)

(52) U.S. Cl.
CPC ..... *H04R 1/2865* (2013.01); *H04R 1/2892* (2013.01); *H04R 1/30* (2013.01); *H04R 1/345* (2013.01); *H04R 2201/029* (2013.01); *H04R 2201/34* (2013.01); *H04R 2400/13* (2013.01)

(58) Field of Classification Search
CPC ..... H04R 1/28; H04R 1/2842; H04R 1/2861; H04R 1/2865; H04R 1/2892; H04R 1/30; H04R 1/345; H04R 2201/029; H04R 2400/13; H04R 1/34; H04R 1/347; H04R 2201/034
See application file for complete search history.

(56) References Cited

U.S. PATENT DOCUMENTS 1,855,836 A 4/1932 King
2,224,919 A 12/1940 Olson
(Continued)

FOREIGN PATENT DOCUMENTS

JP 2007096495 4/2007
RU 2519852 6/2014

*Primary Examiner* — Huyen D Le
(74) *Attorney, Agent, or Firm* — Aleksandr Smushkovich

(57) ABSTRACT

The invention relates to speaker systems for high-quality sound reproduction. It provides a simplified structure of the device, improves the device manufacturability and durability. The speaker system includes the driver, the horn for reproducing low-frequency range sound (rear horn), and the horn for reproducing high-frequency and mid-frequency range sound (front horn); both horns are made in the form of a single enclosure with the capability of mounting the driver in this enclosure, while the enclosure is made of two solid parts symmetrical with respect to the plane of the central vertical section, each part represents a half of the overall profile of the front and rear horns, with no joints at the junction between the front and the rear horns.

2 Claims, 4 Drawing Sheets

(56) References Cited

U.S. PATENT DOCUMENTS

| | | | | | |
|---|---|---|---|---|---|
| 2,858,377 | A | * | 10/1958 | Levy | H04R 1/30<br>181/187 |
| 4,157,741 | A | * | 6/1979 | Goldwater | H04R 1/30<br>381/342 |
| 4,524,846 | A | | 6/1985 | Whitby | |
| 4,807,293 | A | * | 2/1989 | Weckler | H04R 1/2865<br>381/349 |
| 2012/0163648 | A1 | | 6/2012 | Cardas | |

* cited by examiner

FULL ACOUSTIC HORN AND METHOD FOR PRODUCING SAME

CROSS-REFERENCE TO RELATED APPLICATIONS

This application is a U.S. national stage application of a PCT application PCT/RU2017/050128 filed on 14 Dec. 2017, published as WO2018117915, whose disclosure is incorporated herein in its entirety by reference, which PCT application claims priority of a Russian Federation patent application RU2016150614 filed on 21 Dec. 2016.

FIELD OF THE INVENTION

The proposed invention relates to sound transmission devices, namely to speaker systems based on the use of a horn, and can be used for high-quality sound reproduction both in specialized conditions (in movie and concert halls) and at outdoor areas, stadiums, discos, as well as at home, in living quarters.

BACKGROUND OF THE INVENTION

It is known that the horn is an ideal form for efficient sound wave transmission, ensuring the absence of distortion and the "presence effect" when listening. Since ancient times, people have noticed that if the sound is passed through a pipe with a small hole on one side and a large one on the other, it will noticeably increase. Most experts unanimously note a number of sounding benefits inherent in the horn type of loudspeakers, especially the high degree of realism and "presence" (See, for example: J. Dinsdale. Horn Loudspeaker Design. Wireless World, 1974. http://sage-shome.net/files/keep/Dinsdale_Horn_Loudspeakers/).

The main reasons for the lack of popularity of horns are their dimensions and high cost. The cost of manufacturing the horn enclosure usually causes the greatest difficulties.

The ideal exponential horn consists of a straight circular tube, the cross section of which increases logarithmically depending on the distance from the throat (where the loudspeaker is installed) to the mouth. The lowest bass tones require a mouth of a very large area (2-3 sq. m) and a horn itself of at least 6 m in length. On the contrary, the highest tones require a horn with a size of only about 10 centimeters. For this reason, most wide-range horn systems include many separate loudspeakers, each having a corresponding length and mouth area. To accommodate these combinations within an enclosure of reasonable size, bass and even mid-range horns have a square cross-section and are "folded" in a complicated way. Unfortunately, the inevitable restrictions and compromises caused by deviations from the straightness of the axis and the circular cross-section can cause serious variations in the amplitude-frequency response.

Thus, in the aspect of bass reproduction, simultaneous size reduction and performance improvement of the speaker system are two conflicting tasks. The art of engineering the speaker system of acceptable size and cost is not to sacrifice the amazing realism inherent in the ideal horn.

There are known speaker systems incorporating horns, which somehow try to solve the above problem.

For example, there is a known speaker system according to patent for invention RU 2454026 C1, IPC H04R1/30, published on 24 Dec. 2010, which contains a dynamic driver with a diaphragm, connected to a horn that has an acoustic channel for transmitting audio signals. The system characterised in that it is equipped with a pre-horn chamber, the pre-horn chamber is rigidly connected to the horn inlet, and the dynamic driver is located in the pre-horn chamber, the horn is made of at least two sections, the outlet end of the first section is located inside the second section, the second section has a form of a conical flask, and the face of the outlet end of the first section is mounted with a gap to the inner bottom of the second section, the dynamic driver is mounted in the pre-horn chamber with the diaphragm positioned outwards, and the acoustic channel of the horn is made at least exponentially as a flat and smooth surface.

There is also a known speaker system according to patent for invention RU 2201044 C2, IPC H05K5/00, H04R1/02, H04R1/28, 20 Mar. 2003, which contains a loudspeaker, the front part of which serves as the emitter of the primary acoustic signal, and an acoustic horn in the form of a three-dimensional symmetric smoothly expanding figure with a circular cross-section, having, for example, a truncated cone shape, through which passes an acoustic signal of the rear part of the loudspeaker. The acoustic horn of this system is made of a thin, elastic material capable of retaining the originally specified shape, while a loudspeaker is tightly installed in a smaller opening of the horn, the rear part of the loudspeaker is facing the inside of the acoustic horn, and the horn aperture is coupled with a two-layer coating, the inner layer of which is made of sound-absorbing material, and the outer layer is made of solid material serving as a base for mounting or installing the device.

The disadvantage of these speaker systems is the lack of an amplifying horn element for high and midrange frequencies, which adversely affects the quality of sound reproduction. In addition, these devices are quite difficult to manufacture.

There is a known speaker system according to patent for invention RU 2321186 C1, IPC H04R1/28, 27 Mar. 2008, which contains an enclosure with high-frequency (tweeter) and low-frequency (woofer) loudspeakers mounted on its front panel tilted towards the rear panel, while the lower side of the front panel is rigidly connected to the front side of the bottom wall of the enclosure. The front panel of this system is offset inside the enclosure relative to the plane of its front vertical opening so that the sides and the top of the front panel respectively are rigidly connected to the side and top walls of the enclosure, the tweeter is provided with a horn formed by the part of the front inclined panel, which is rigidly connected to the two sidewalls and the canopy rigidly connected to each other and to adjacent sections of the perimeter of the front vertical opening of the enclosure.

Although this engineering solution contains a horn element, its effectiveness with regard to sound transmission at low frequencies seems doubtful.

The engineering solutions closest to the proposed group of inventions, which were taken for the prototype, are the acoustic horn and method of its manufacture disclosed in the patent for invention RU 2519852 C1, IPC H04R1/28, 20 Jun. 2014.

The prototype device is an acoustic horn comprising an enclosure with an inlet opening (throat) and an outlet opening (mouth) having a larger lateral dimension than the inlet one, there is a cavity inside the enclosure connecting these openings, which is bounded by a wall with a profile of the inner surface curve in mutually perpendicular directions corresponding to an exponent and/or tractrix, while the enclosure is made of the central part having a width of no less than the lateral dimension of the inlet opening, and two side parts attached to the central part to its side surfaces, the central part is made of a set of plates attached to each other by side surfaces, in each plate there is an end wall which forms part of the enclosure cavity and has a curved profile corresponding to an exponent or tractrix, and each side part is formed by successively attaching to each other the plates with a thickness of at least 0.1 mm to form a stepped curve in the direction perpendicular to the plane of symmetry of the enclosure, corresponding to an exponent and/or tractrix, and which is circumscribed by discrete points with a pitch equal to the thickness of the plates of side parts.

As part of the speaker system, the prototype device is shown in the explanatory figure in the form of the horn speaker enclosure connected to the driver from the rear side (rear horn).

The method of manufacturing an acoustic horn according to the prototype is to create a full-size graphic model of a horn with a profile of the inner surface curve in mutually perpendicular directions corresponding to an exponent and/or tractrix; divide the model into the central part and the two side parts adjacent to it; separate each part of the graphic model of a horn by vertical planes parallel to the plane of symmetry and spaced one from another in order to make patterns; cut flat elements according to patterns from the thin-walled plate with a thickness equal to the distance between vertical planes; and connect flat elements by adjoining them to each other with flat sides.

The alternative method of manufacturing an acoustic horn according to the prototype is to create a full-size graphic model of a horn with a profile of the inner surface curve in mutually perpendicular directions corresponding to an exponent and/or tractrix; divide the model into the central part and the two side parts adjacent to it; separate the central part of the graphic model of a horn by vertical planes parallel to the plane of symmetry and spaced one from another in order to make patterns; cut flat elements according to patterns from the thin-walled plate with a thickness equal to the distance between vertical planes; and connect flat elements by adjoining them to each other with flat sides to create the central part of the horn, then each side part of the horn is formed by successively attaching to each other the plates with a thickness of at least 0.1 mm to form a stepped curve in a plane perpendicular to the plane of symmetry of the acoustic horn, corresponding to an exponent and/or tractrix, which is circumscribed by discrete points with a pitch equal to the thickness of the plates, and then the side parts are attached to the sides of the central part.

By creating a horn profile close to an exponent or tractrix, the prototype device should provide the highest quality of sound transmission in the low-frequency range compared to the alternatives mentioned above.

However, the prototype device still has the following disadvantages:

1. Lack of a horn sound transmission element for high and midrange frequencies, which impoverishes the overall sound.
2. Complexity and labour intensity of manufacturing the device, the need to use a large share of manual labour in the manufacturing process, high cost of production.

OBJECTIVE AND BRIEF SUMMARY OF THE INVENTION

The aim of the proposed invention is to create a speaker system suitable for use in living quarters as well, easy to manufacture and at the same time providing high quality of sound transmission in a wide frequency range, including both high and midrange frequencies (250 Hz and higher) and low frequencies (60 to 250 Hz).

The proposed invention ensures the achievement of the following technical result:

1. In respect of the device—improving the quality of sound transmission, efficient reproduction of transmitted sound over a wide frequency range while reducing its distortion, achieving the effect of "surround" sound, as well as simplifying the device structure, which leads to device cost reduction for consumers and maintainability enhancement.
2. In respect of the method of producing the device—improving the manufacturability of the device, increasing the device durability, ability to manufacture the device in one production cycle, ability to manufacture the device in series, and, therefore, the device manufacturing cost reduction.

The above technical result in respect of the device is achieved by additionally equipping the speaker system, comprising a driver and a horn located on its back for reproducing low-frequency range sound (rear horn), with a horn for reproducing high-frequency and mid-frequency range sound (front horn), making both horns in the form of a single enclosure with the capability of mounting the driver in this enclosure in the seat provided for it.

The above technical result in respect of the method of manufacture of the device is achieved by manufacturing the enclosure of the speaker system of two halves symmetrical with respect to each other relative to the section plane by connecting them in a known manner.

The proposed device is a speaker system comprising a sound source—a driver consisting of at least a diaphragm (membrane), a diaphragm suspension and a driver basket, and a horn located on the back side of the driver for reproducing low-frequency range sound (rear horn) in the form of a contour flaring according to the specified calculation, consisting of the inlet opening (throat), aperture and outlet opening (mouth). According to the invention, the speaker system additionally includes a horn for reproducing high-frequency and mid-frequency range sound (front horn), with both horns made in the form of a single enclosure with the capability of mounting the driver in this enclosure in the seat provided for this.

The driver mounting seat can be made at the front horn side, for example, it can be located directly in the throat of the front horn, while the driver is installed in the area between the throat of the front horn and the throat of the rear horn, so that the driver diaphragm faces the front horn and the back side faces the rear horn.

To improve the quality of sound transmission and protect the sound against distortions, the device can be equipped with a compensating element that restores the desired profile of the front horn in the area of its throat, where the specified profile formed by the device enclosure is broken by the driver mounting seat. The compensating element can be made in the form of a ring having a three-sided shape in section, formed by two straight sides connected at right angle and one curvilinear side calculated in accordance with the selected profile of the front horn. The compensating ring is installed end-to-end with the perimeter of the throat of the front horn on top of the driver basket located on the driver mounting seat in the device enclosure.

This structure of the device allows the driver to be installed in the finished device enclosure from the front horn side, while the compensating ring installed next restores the geometry of the front horn throat after the driver is installed, which allows for avoiding sound distortions in the area of the front horn throat during sound reproduction.

To avoid penetration of high and midrange frequency sound waves through the rear horn, at least part of its inner surface can be damped with sound-absorbing material.

For the best sound reproduction, the profiles of the front and rear horns shall be made with a contour having a shape of exponential and/or tractrix curve.

It should be noted that the compensating element described as part of the proposed speaker system makes it possible to further improve the sound transmission characteristics in any horn systems with a horn enclosure and a driver built into the throat of such a horn. Considering this independent technical result achieved with the help of the proposed compensating element, it is possible to single out the presence of such compensating element as an essential feature of an independent claim relating to an acoustic horn (as a unit of the proposed speaker system).

The acoustic horn includes a driver consisting of at least a diaphragm (membrane), a diaphragm suspension and a driver basket, and an enclosure in the form of a contour flaring according to the specified calculation, consisting of the inlet opening (throat), aperture and outlet opening (mouth). According to the invention, the driver basket is installed in the horn throat area in a special seat formed by a protrusion on the inner surface of the horn enclosure, while a compensating element is installed over the driver basket, it restores the above said profile of the horn in its throat area, where the specified profile formed by the enclosure is broken by a protrusion serving as a driver mounting seat. The compensating element can be made in the form of a ring having a three-sided shape in section, formed by two straight sides connected at right angle and one curvilinear side calculated in accordance with the selected profile of the horn.

The proposed method of manufacturing the speaker system includes creating a graphic model of the speaker system enclosure, dividing the model into parts, manufacturing the enclosure parts and connecting them in a known manner, wherein, according to the invention, the graphic model of the speaker system enclosure includes the front and rear horns combined in one-piece enclosure for transmitting sounds of high and low frequencies, respectively (full horn), the model is divided into two parts (halves) symmetrical with respect to the plane of the central vertical section.

According to a preferred implementation of the method, the graphic model of the speaker system enclosure includes a seat for the driver.

The driver seat is preferably made in the front horn throat area in the form of a protrusion on the inner surface of the enclosure.

Two halves of the enclosure can be manufactured using many well-known technologies (casting, stamping, fiberglass, carbon fiber, etc.) from a hard, minimum resonant material. In this case, the method for the invention makes it possible to easily manufacture in this manner the profiles of horns of almost any complexity. Two halves of the enclosure can be connected to each other by such known methods as gluing, soldering, welding, etc.

After connecting the two halves of the enclosure to each other, a driver basket is installed from the front horn side to the seat made in the enclosure, for example, it is fixed with screws, bolts, glued or attached to the seat in some other way. After that, the above described compensating element, which restores the front horn profile, is installed over the driver basket from the front horn side.

BRIEF DESCRIPTION OF DRAWINGS OF THE INVENTION

FIG. 1 is the general view of the produced device (photo)

FIG. 2 is the device enclosure drawing (top view);

FIG. 3 is the device enclosure drawing (front view);

FIG. 4 is the device enclosure drawing (side view);

FIG. 5 is the sectional drawing of the device enclosure (central vertical section);

FIG. 6 is the enlarged drawing of the device unit (acoustic (front) horn with a driver) (central vertical section).

DESCRIPTION OF PREFERRED EMBODIMENTS OF THE INVENTION

Figure 1:
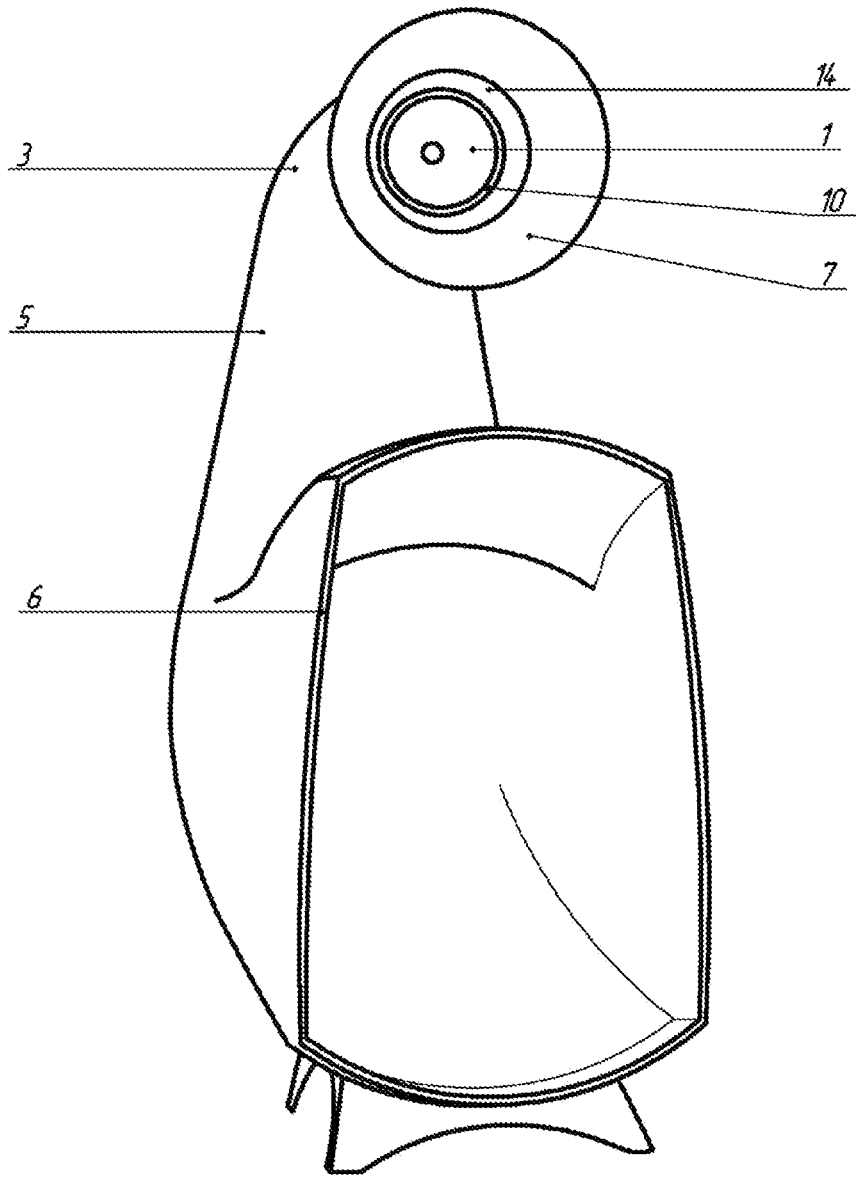
FIGS. 1 to 6 show the device in one of the possible variants of its implementation.
Figure 2:
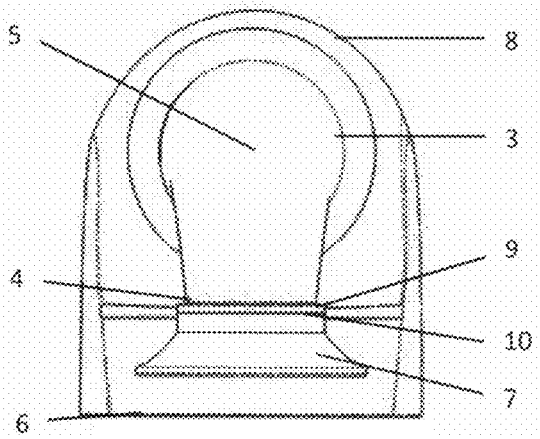
Figure 3:
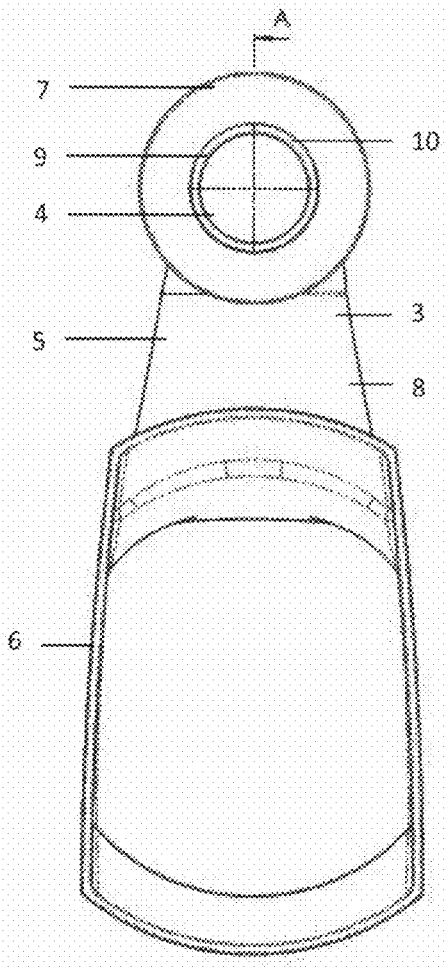
Figure 4:
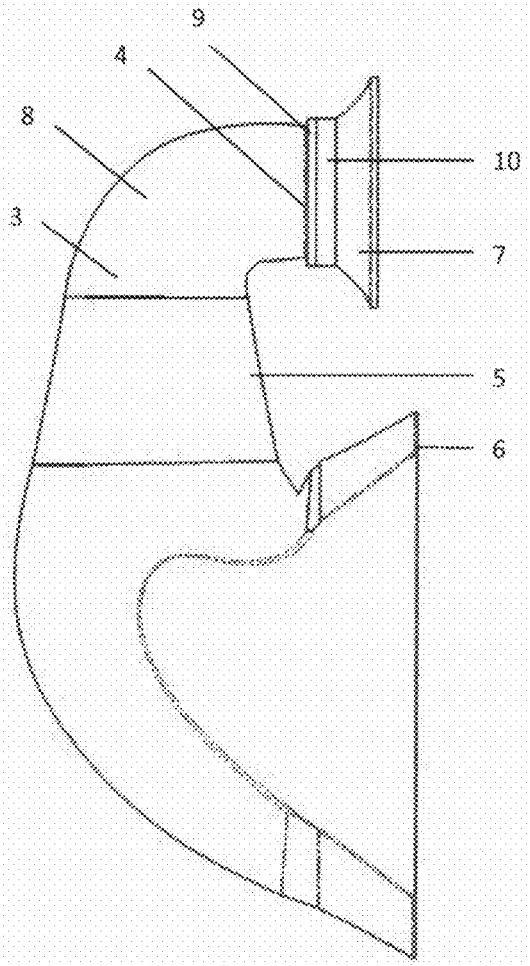

The speaker system includes the driver 1, and the horn 3 located on the back side 2 of the driver 1 for reproducing low-frequency range sound (rear horn 3) in the form of a contour flaring according to the specified calculation, consisting of an inlet opening (throat) 4, aperture 5 and outlet opening (mouth) 6. The speaker system additionally includes a horn 7 to amplify sound in high-frequency and mid-frequency range (front horn 7), both horns 3 and 7 are made in the form of a single enclosure 8 with the capability of mounting the driver 1 in this enclosure 8 in the seat 9 provided for this.

Seat 9 for mounting the driver 1 is made on the side of the front horn 7, it is located directly in the throat 10 of the front horn 7, while the driver 1 is installed in the area between the throat 10 of the front horn 7 and the throat 4 of the rear horn 3, so that the diaphragm 11 of the driver 1 faces the front horn, and the back side 2 faces the rear horn 3.

Figure 5:
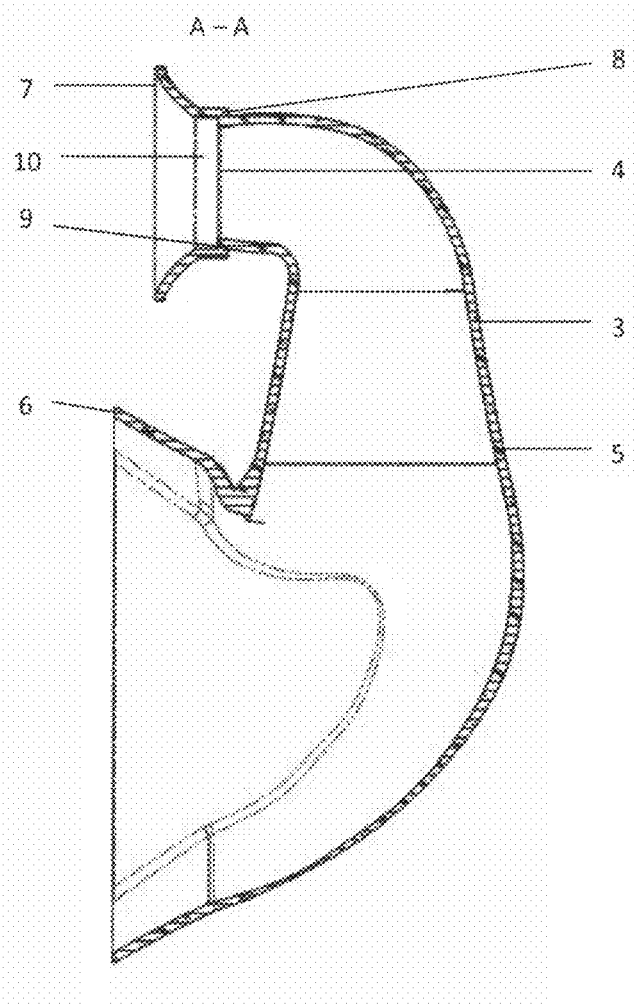
Figure 6:
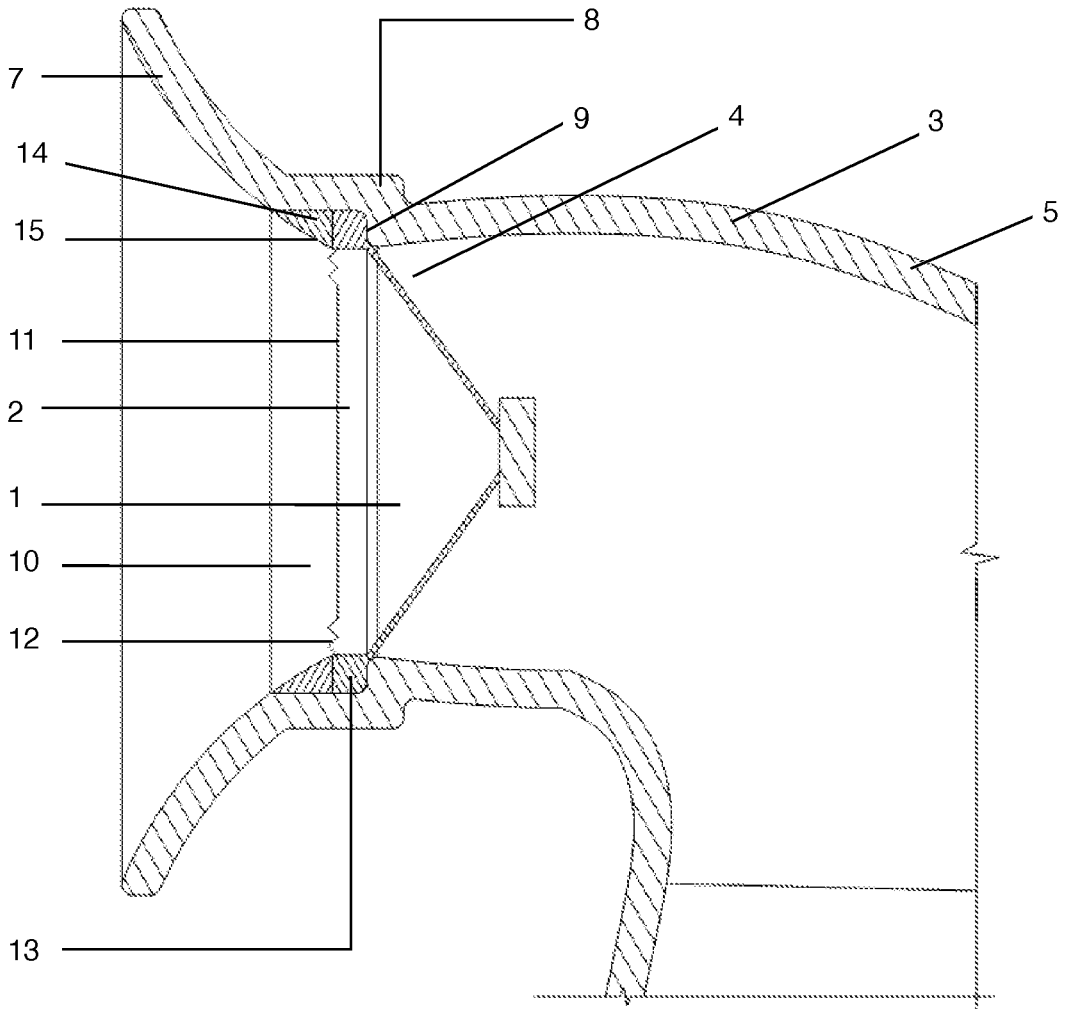

The enlarged drawing of the speaker system unit—an acoustic horn (front horn)—is shown in FIG. 5.

The acoustic horn includes the driver 1 consisting of at least the diaphragm (membrane) 11, the suspension 12 of the diaphragm 11 and the basket 13 of the driver 1, and the enclosure 8 itself—the horn. Basket 13 of the driver 1 is installed in the area of the horn throat 10 in a special seat 9 formed by a protrusion on the inner surface of the horn enclosure 8.

To improve the quality of sound transmission and protect the sound against distortions, the device is equipped with a compensating element 14 that restores the desired profile of the front horn 7 in the area of its throat 10, where the above said profile formed by the device enclosure 8 is broken by a protrusion serving as a seat 9 for mounting the driver 1. The compensating element 14 is made in the form of a ring having a three-sided shape in section, formed by two straight sides connected at right angle and one curvilinear side 15 calculated in accordance with the selected profile of the front horn 7. Compensating ring 14 is installed end-to-end with the perimeter of the throat 10 of the front horn 7 on top of the basket 13 of the driver 1, installed on the seat 9 for mounting the driver 1 in the device enclosure 8.

The device operates as follows.

The sound from the driver 1 enters simultaneously the front horn 7 and the rear horn 3. At the same time, sounds of high and midrange frequencies are transmitted from the diaphragm 11 of the driver 1 through the front horn 7, the compensating ring 14 aligns the profile of the front horn 7 in the area of the throat 10, which ensures sound transmission at high and midrange frequencies with virtually no distortions. Low-frequency sounds are transmitted from the back side 2 of the driver 1 through the rear horn 3, forming a high-quality bass sound at the output.

The invention claimed is:

1. Acoustic horn that includes a driver consisting of at least a diaphragm, a diaphragm suspension and a driver basket, and an enclosure in the form of a contour flaring according to a calculation, consisting of a throat, an aperture and a mouth, characterized in that the driver basket is installed in an area of the throat in a seat formed by a protrusion on an inner surface of the enclosure, while a compensating element is installed over the driver basket, which restores a profile of the horn in the area of the throat, wherein the profile formed by the enclosure is broken by the protrusion serving as a driver mounting seat.

2. Acoustic horn defined in claim 1, characterized in that the compensating element is made in the form of a ring having a three-sided shape in section, formed by two straight sides connected at right angle and one curvilinear side calculated in accordance with the profile of the horn.

* * * * *